United States Patent [19]

Eickmann

[11] 4,213,746

[45] Jul. 22, 1980

[54] INTERNAL GEAR HYDRAULIC DEVICE WITH BALANCING RECESSES IN THE HOUSING AND CRESCENT SHAPED SEPARATION MEMBER

[76] Inventor: Karl Eickmann, 2420 Isshiki, Hayama-machi, Kanagawa-ken, Japan

[21] Appl. No.: 859,789

[22] Filed: Dec. 8, 1977

[51] Int. Cl.[2] ..... F03C 3/00; F04C 1/06; F04C 5/00; F04C 15/00

[52] U.S. Cl. ..... 418/71; 418/126; 418/129; 418/170

[58] Field of Search ..... 418/125, 126, 129, 71, 418/170, 169

[56] References Cited

U.S. PATENT DOCUMENTS

| | | | |
|---|---|---|---|
| 260,678 | 7/1882 | Hardy | 418/170 |
| 1,646,615 | 10/1927 | Furness | 418/170 |
| 3,265,005 | 8/1966 | Ringgenberg | 418/170 |
| 3,486,459 | 12/1969 | Eltze | 418/126 |
| 3,496,877 | 2/1970 | Eckerle et al. | 418/126 |
| 3,586,465 | 6/1971 | Eltze | 418/126 |
| 3,759,639 | 9/1973 | Molly | 418/71 |
| 4,132,514 | 1/1979 | Eckerle | 418/71 |

FOREIGN PATENT DOCUMENTS

| | | | |
|---|---|---|---|
| 1266134 | 4/1968 | Fed. Rep. of Germany | 418/71 |
| 1403924 | 11/1968 | Fed. Rep. of Germany | 418/170 |
| 2533646 | 2/1977 | Fed. Rep. of Germany | 418/126 |
| 2614048 | 10/1977 | Fed. Rep. of Germany | 418/126 |

*Primary Examiner*—John J. Vrablik

[57] ABSTRACT

A high pressure internal gear pump has an inner rotor with outer gear-type teeth inside of an outer rotor with inner gear type teeth. The outer rotor is eccentrically revolving relatively to the inner rotor, whereby the gear-teeth are meeting each other as known from the former art. A half-moon like part is provided between the inner and outer rotor as usual in such pumps. The invention provides slots for the reception of pressure in the part between the teeth or in the housing surrounding the outer rotor. The pressure in said slot or slots presses the neighboring portions against the inner- and-/or outer rotor for more perfect seal at high pressure. In addition an axially adjusting thrust body may be provided to seal the ends of the rotors. The mentioned slots may have enlargements on suitable locations in order to make the adjacent sealing parts more flexible for suitable sealing engagement with the respective portions of the rotors. Rotors and separation member can float freely under balanced fluid pressure loads.

4 Claims, 6 Drawing Figures

INTERNAL GEAR HYDRAULIC DEVICE WITH BALANCING RECESSES IN THE HOUSING AND CRESCENT SHAPED SEPARATION MEMBER

BACKGROUND OF THE INVENTION

Some years ago an internal gear pump was published which is capable of very high pressure and very good volumetric efficiency. Said pump works eccellent in practical application. However, said pump is very complicated and has many parts. In addition, it is not possible to adjust it to medial or low pressure range with good mechanical efficiency. It has an outer thrust body which thrust the outer rotor against the inner rotor under fluid pressure. This provides the tight seal, but it causes friction and consists of many difficult configurated parts, which are expensive in fabrication.

It is therefore the aim and intention of this invention to overcome the machining difficulties of the known internal gear pump and at same time to make the pump of the invention also effective for low and medium pressure range applications.

SUMMARY OF THE INVENTION

It is therefore the first object of the invention, to provide an internal gear pump, which is easy and inexpensive at manufacturing.

The second object of the invention is, to provide an internal gear pump, which has a basic structure, which makes it possible to apply it economically with good efficiency for low pressure, for medial pressure or for high pressure range application.

In order to realize the said first and/or second object of the invention, it is the third object of the invention to provide a slot or slots in the separation control member, which is located between the inner and outer rotor of the device.

A fourth object of the invention is to provide enlargements on said slots of the third object, in order to obtain a better flexibility and deformability of the seal portions of the said separation-control-member. Said seal portions are the portions of the said separation control member, which are separated from each other by said slots.

The fifth object of the invention therefore is, that said seal portions of said separation control member are pressed by fluid in said slots against the respective inner- and/or outer-rotor for fluid-tight seal at the desired pressure-range.

The sixth object of the invention is, to provide an housing around the outer rotor of the device and provide in said housing at least one slot and a communication means to pass fluid under pressure into said slot.

The seventh object of the invention is, to provide at least one slot-enlargement in said housing in order to form a deflectable portion in said housing.

The eighth object of the invention is, to lead fluid under pressure into said slot in said housing and thereby to press said deflectable portion of said housing into sealing engagement with the outer rotor of the device.

A further object of the invention is, to provide a radial fluid pressure balance to the said inner and outer rotor either partially or completely.

In order to realize said further, the nineth object of the invention, the slot in said housing is set into relationship to the high pressure chamber area in the device in order to counteract the pressure forces on the deflectable housing portion radilly from outside and inside. By doing so, the pressure forces onto the outer rotor are also radially balanced from radially inside and outside. This is the tenth object of the invention.

In order to realize a less friction motion between the inner face of the deflectable housing portion and the outer face of the outer rotor, the deflectable housing portion may be provided with radially inwardly directed lubrication recesses and thereto communicated fluid pressure passages, which form together the eleventh object of the invention.

The twelfth object of the invention is, to provide a pressure balancing recess and thereto communicated pressure passages on the separation control member. Said pressure balancing recess in said separation control member thereby contains fluid under pressure which is acting radially against the inner rotor of the device. The location of the pressure balancing recess is so provided and dimensioned, that it at least partially or totally counteracts the pressure forces of fluid onto the diametrically opposite portion of the inner rotor.

The nineth to twelfth objects of the invention can thereby free both rotors, the inner and the outer rotor from any resultant radial pressure fluid forces, so, that the rotors revolve without any remaining radial load between each other balancing radial fluid pressure forces. Any deformation of the rotors is thereby prevented and the rotors obtain a long and useful as well as highly efficient life.

It is also possible, to let the rotors float between axial forces of fluid under pressure and at the same time to seal the axial end faces of the rotors effectively.

That can be done by the thirteenth object of the invention, which for said purpose provides an axial thrust body in a respective thrust chamber at one axial end of the rotors. This thrust body as well as the bearing body on the other end of the rotor may contain respective lubrication recesses and communication passages. Instead of providing one thrust body on one end of the rotor or rotors, it is also possible to provide on each end of the respective rotor or rotors thrust bodies or seal body means.

The described objects of the invention may be provided either single or in combination, depending thereon how good the sealing shall be and/or thereon, for which pressure range the device shall be applied. The internal gear pump is described primarily as a pump, but it can similarly act as a fluid motor, if suitably designed, built and applied.

Another object, and thereby the fourteenth object of the invention is, to provide a space in the separation-control-member of the device and insert into said space a radially moveable sealing- and/or thrusting insertion for sealing along the inner or outer rotor of the device.

The fifteenth object of the invention is, to provide pressure balancing recesses in said insertions of the fourteenth object of the invention.

The sixteenth object of the invention is, to make the outer rotor float radially between forces of fluid under pressure and at the same time also to make also the inner rotor and the separation-control-member partially or totally free from remaining fluid pressure loads, so, that the bearings do not need to carry high load and that the pump or motor obtains a high life and good efficiency;

and the final object of the invention is, to materialize one or more of the objects of the invention by simple application of bores and slots in the respective parts or members.

DESCRIPTION OF THE PREFERRED EMBODIMENTS

Figure 1:
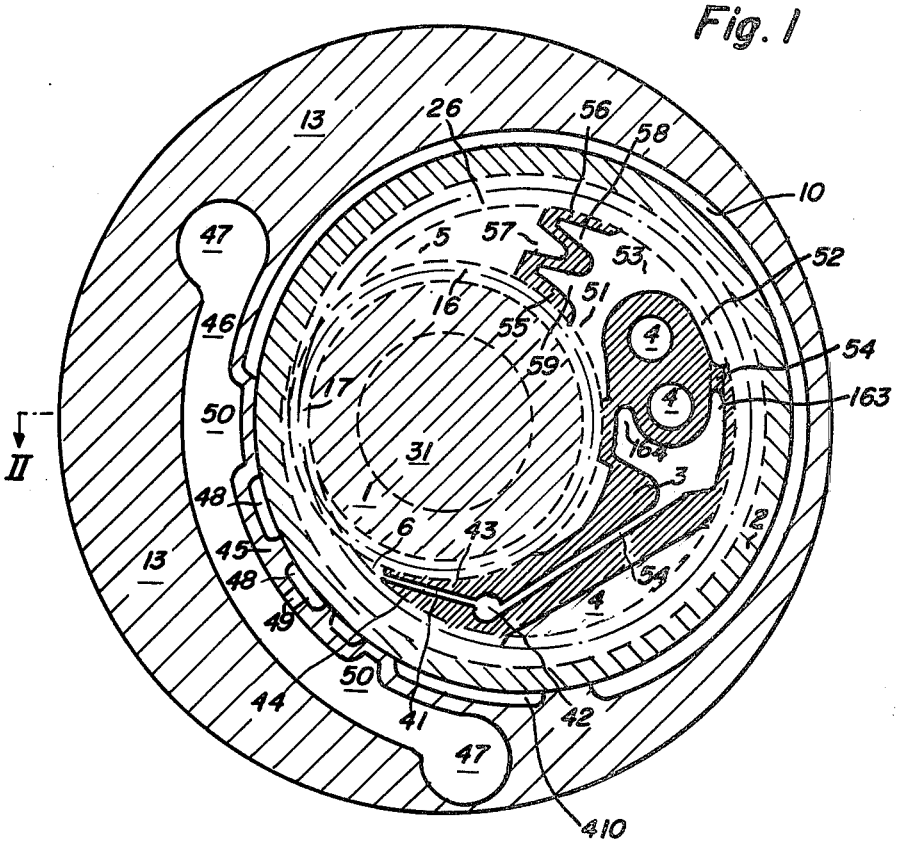
FIG. 1 is a cross-sectional view through FIG. 2 along the line II—II in part, where the outer housing is not drawn, because it does not contain any novelty.

Rotor 1 is the inner rotor and borne in bearings 11 in housing 12. Housing 12 may contain an inner housing 13. The housing has end-portions or covers 14 and 15 on both ends, which contain the bearings 11. The outer rotor 2 surrounds radially the inner rotor 1. The inner rotor 1 is integral with shaft 31 or fastened to shaft 31.

The inner rotor has outer teeth 16 and the outer rotor has inner teeth 26 which engage each other at area 17. The forms of the gear teeth may be of any kind of the former art of internal gear pumps or of any suitable configuration. The sealing engagement of the teeth of the inner and outer rotor may also be as usual in internal gear pumps.

The outer rotor is eccentrically located relatively to the inner rotor, whereby the inner rotor revolves around the centrical axis and the outer rotor revolves around an eccentrical axis. The said axes are distanced from each other radially. By the eccentric location of the outer rotor relatively to the inner rotor a fluid containing space is formed between said rotors. This fluid containing space is divided into a suction chamber and into a delivery chamber by the insertion of the separation control member 3 into said fluid containing space between said inner and outer rotors. The said separation control member 3 may be integral with one of the housing-end portions or covers or it may be fastened by a holding means, like a pin or pins 4 to one or both end portions or covers 14 and/or 15.

Thus, between the said rotors 1 and 2 and the covers 14,15 and the separation control member 3 the suction chamber 5 and the exit chamber 6 are formed. The device may further contain a sealing insertion 7 with an inner seal face 8 for sealing along the end faces 9 on each one end of the rotors.

One of the end portions or covers, for example cover 15 may be provided with a space for the reception of a thrust body 18.

Thrust body 18 may have an eccentric shoulder 19 to be received in a respective portion of the space in one of the covers, for example 15, to form a pressure thrust chamber 22 for pressing the said thrust body 18 under force of pressure in fluid towards said rotors. A second sealing insertion 23 may be provided between said thrust body 18 and the other end faces 25 of the rotors for sealing with an innermost seal face 24 along said end faces 25 of the rotors. The purpose of the seal insertions is, to provide matching materials for running along each other and thereby not to weld. If however, the end portion or cover 14 is of material which matches the running rotor end faces 9 and if the thrust body 18 is of matching material, which does not weld along the other endfaces 25 of the rotors, the said sealing insertions can be spared.

One or both covers or end portions 14,15 may be provided with an entrance port and entrance passage 20 for leading the suction fluid into the suction chamber 5. Similarily one or both end portions or covers 14,15 may have a respective exit passage and exit port 21. In FIG. 1 the exit passage 21 extends through the thrust chamber 22, whereby pressure fluid is led into the thrust chamber 22.

It should be recognized, that the drawings illustrate primarily the slots of the invention in relation to the sealing of the rotors. In order to show also the fluid passages in the same drawing, the cover 15 is about 90 degrees turned shown in FIG. 1. Such style of illustration has become common praxis in applicant's handbooks of hydraulics, because it is the most convenient way of illustration of all important parts and their functions.

In FIG. 1 the slot 41 is visible and on the root of slot 41 we see the slot enlargement 42, which may be a simple axially extending bore. It is convinient to drill said bore 42 into the separation control member 3 and then mill from the pressure chamber 6 the slot 41 into said member 3. Said slot 41 now divides the pressure-chamber adjacent pressure end of member 3 into two seal portions 43 and 44. Thereby fluid under pressure enters from the pressure chamber 6 into slot 41 and bore 42, whereby the seal portion 43 is pressed against the outer faces of the teeth of the inner rotor 1 and the seal portion 44 is forced against the inner faces of the teeth of the outer rotor 2. Thus, the inner and outer rotors are effectively sealed towards the pressure chamber 6. Thus, the pressure chamber 6 is effectively sealed towards the separation control member 3. For perfect work of said seal portions 43 and 44, the slot 41 and the bore 44 are so dimensioned, that the seal portions 43 and 44 are flexible enough to deform slightly in the direction towards the teeth of the inner and outer rotor to achieve and maintain the desired sealing effect at best minimum of friction.

Good care should be given to the exact design and machining as well as the selection of suitable material for said slot 41, enlargement 42 and said seal portions 43 and 44.

Figure 2:
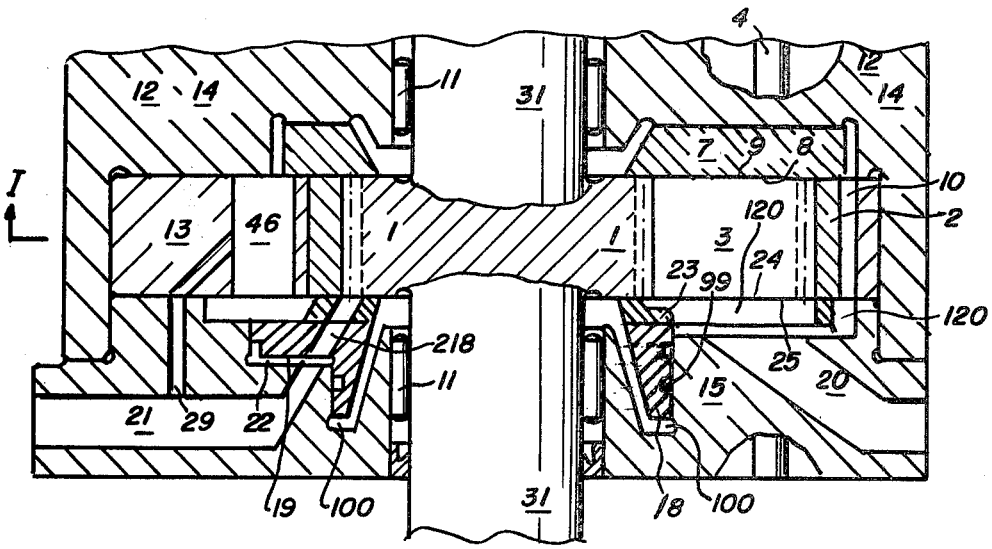
FIG. 2 is a longitudinal sectional view through an embodiment of the invention, demonstrating one of the preferred embodiments of the internal gear type fluid handling device of the invention.

Inner housing portion 13 is, if so desired, provided with a guide portion or guide portions 45 and with a pressure chamber 46 therebehind. FIG. 2 demonstrates, how a practical design is machined in a simple way. Enlargements or bores 47 are casted or drilled and the peripheral ends of the pressure chamber 46. Chamber 46 is either i.e. casted, milled or brached. Passage 29 leads fluid under pressure for example from the exit passage 21 into the pressure chamber 46. Guide portion(s) 45 may be provided radially from inside with lubrication recess(es) 48 which receive fluid under pressure from pressure chamber 46 through passages 49.

Recess(es) 48 may also serve as intersecting recesses for the prevention of welding between the outer face of the outer rotor 2 and the inner face of the housing 13. Such intersecting recesses will then be partially or totally be filled with fluid from the fluid which passes as small leakage between the narrow clearance between the outer rotor 2 and the inner face of the housing 13. Recess(es) 548 of FIG. 6 may also be provided also as intersecting recesses in the same manner as recess(es) 48 in FIG. 1. Recess(es) 580 in FIG. 6 may act as lubrication recess and receive fluid from the communicated pressure chamber 546.

Guide portion 45 is pressed by fluid pressure in chamber 46 against the outer face of the outer rotor. Here again, good care must be given for an accurate design and machining as well as metarial in order to obtain the respective flexibility or deformation of the guide portion 45. Thereby the guide portion 45 is pressed against the outer face of the outer rotor and at same time the outer rotor 2 is pressed for closely running in the gears of the inner rotor 1. By said pressing force the teeth of the inner and outer rotors 1 and 2 are closely engaging each other in the area 17 and they engage so closely, that the pressure delivery chamber 6 is closely sealed in this peripherial direction by the close engagement of the said teeth 16 and 26 of the inner and outer rotors 1 and 2. The outer rotor 2 may be radially freely assembled, so that it can move radially towards the inner rotor 1 under said force of pressure in fluid in chamber 46. The thrust area and thrust force of portion 45 should consequently be designed to be higher than the thrust force out of slot 41 of member 3. The lubrication recesses 48 serve the purpose of good lubrication between outer rotor 2 and guide portion 45. Slots 50 can be provided in order to increase the flexible deformability of the guide portion(s) 45. In order to assure the desired radial move-ability of the outer rotor 2 the free space 10 is provided and located diametrically opposite of the mentioned guide portion 45 radially outwards of rotor 2 in housing 13 or 14.

Another style of radial fluid pressure balance of the rotors 1 and 2 or of one thereof is possible by the following application, which again, may be applied singularily or in combination with the other radial balancing means of the invention. Separation control member 3 may be provided with an inner balancing chamber 51 for leading radial fluid pressure to the inner rotor 1 diametrically opposite of the pressure delivery chamber 6. Fluid under pressure may be led into said pressure chamber 51 by a passage 54 from the pressure delivery chamber 6, for example through slot 41. Rotor 1 floats then effectively between radially opposed fluid pressure fields, when the dimensions and locations are suitably provided. The free-floating of the outer rotor 2 under diametrically located and opposed fluid pressure fields can be achieved and maintained by the provison of another pressure chamber 52 in the outer end of the separation control member 3. Said fluid pressure chamber 52 may receive fluid under pressure from the pressure delivery chamber 6 through passage 53. In case of suitable location and dimensioning of pressure chamber 52 the outer rotor 2 floats under radially each other balancing fields of fluid under pressure, because the chamber 52 is directed from radially inside against the outer rotor 2. Thus, chamber 52 acts oppositionally and diametrically to the fluid pressure delivery chamber 6. When said pressure chambers 51 and/or 52 are provided in the separation control member 3, it is suitable to provide back-end seal portions 55 and/or 56 on the back ends of said pressure chambers 51 and/or 52. "Pressure-chambers 51 and 52 are open towards the respective rotor 1 or 2.

Figure 3:
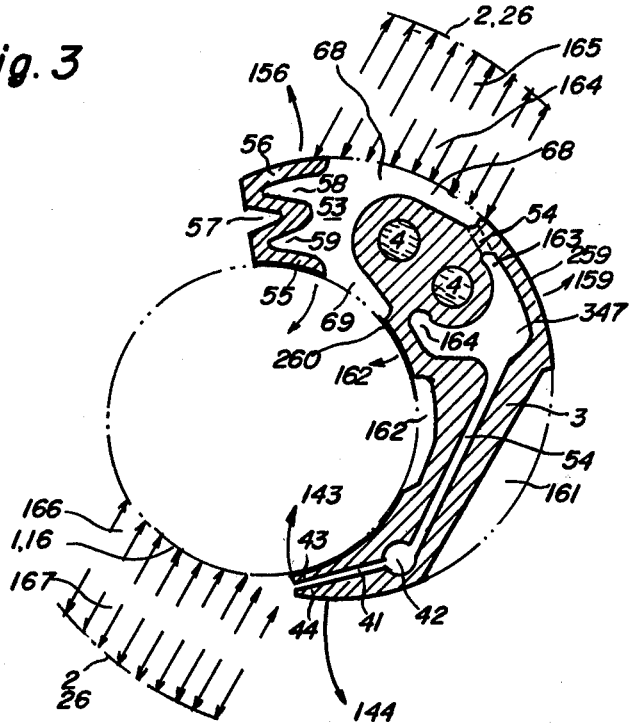
FIG. 3 is a cross-sectional view through another embodiment of an alternative of a separation-control-member of the invention, wherein the pressure forces are illustrated in a schematic wherein the inner faces of teeth of the outer rotor are drawn partially radially distanced from the separation-control member in order to make the illustration of the fluid pressure forces possible.

To make the back end seals 55 and/or 56 effective, it is suitable to provide slot 58 and 59 in the end portion of the member 3 and fill it with pressure in fluid from one of the said pressure chambers 51 or 52. In order to obtain again a good flexibility and deformability of the end seal portions 55 and 56 respective intersecting slots 57 may be provided from the back end into the separation control member 3. Respective communication passages between recess or slot 57 and pressure chambers 51 and 52 are provided as will also be seen in FIG. 3. In FIG. 3 the separation control member 3 is separatedly shown. The figure is provided in order to demonstrate the deformation direction of the seal portions, to demonstrate the radial balancing action upon the rotors and also in order to demonstrate the possibility of adding of additional seal-lips or sealing portions.

The seal portion or sealing lip 43 deforms under the fluid pressure in slot 41 in the direction of arrow 143 against the outer diameter of the teeth of inner rotor 1 and seals along them. Sealing lip or seal portion 44 deforms under the pressure in fluid in slot 41 in the direction of arrow 144 towards the inner diameter of the teeth of rotor 2 and thereby seals along them. The sealing portion or sealing lip 56 deforms in the direction of arrow 156 towards the outer rotor and thereby seals along the inner diameter of the teeth of said outer rotor 2. The deformation of lips 55 and 56 takes place under the forces of pressure in fluid in recess 58 and 59. Seal portion or sealing lip 55 deforms correspondingly in the direction of arrow 155 towards the outer diameter of the teeth of the inner rotor 1 and consequentely seals there along. Attention should be given to slot or recess 57. Its location and dimensioning is important, because it defines the size of deformability of lips 55 and 56 under a given pressure. Without such slot or recess 57 there might not be much deformability of lips 55 and 56. The pressure in recesses 58,59 acts also in the direction towards slot 57. Thereby the small narrow portions of member 3 between slots 57,58 and 59 trend to deform in the direction away from recesses 58,59, whereby they are pressing the sealing portions 55 and 56 in the said directions towards sealing engagement along the respective portions of rotors 1 and 2.

The separation and control-member 3 in FIG. 3 has an inner fluid pressure balancing pocket 69 and an outer fluid-pressure balancing pocket 68. Passage 54,53 may lead fluid under pressure from one of the spaces under pressure, for example from pressure delievery chamber 6 into one or both of balancing recesses 68 and/or 69. In such case it is preferred, if high pressure is desired, to add additional sealing portions or seal-lips 259 and/or 260. slots 163 and/or 164 separate said sealing lips 259 and/or 260 partially from the main portion of member 3. Passage 54 may lead fluid under pressure into said recesses or slots 163 and/or 164. Intersecting recesses 163 and/or 164 may be provided into member 3 in order to make the suitable deformation of lips 259 and/or 260 possible in the desired extend.

Thus, while the balancing pockets 68 and/69 are sealed in the one direction by sealing lips 55 and/or 56, they are also sealed in the other direction, namely by sealing lips 259 and/or 260. When the pump or device is considered to work at low or at medial pressure only, the member 3 is fitted by close clearance. It seals then by the close clearance against the inner and outer rotors 1 and/or 2. The respective recesses and sealing portions or sealing lips or seal-portions can then be spared and are not necessicarily provided. For high-pressure delivery of fluid however, the said slots, recesses and seal portions or sealing lips provide a tight seal and thereby a very high volumetric and overall efficiency of the machine.

The purpose of provision of the balancing pockets 68 and/or 69 is, to take all radial load from the inner and /or outer rotor at least partially away. In the internal gear pump of the former art, mentioned earlier in this specification there is such a high radial load on the inner rotor, that specially deflectible bearings were necessary in order to prevent sticking of the inner rotors in the respective bearings. As higher as the pressure in the delivery fluid becomes, as higher will be the load on the inner and/or outer rotor of the device. That would either require very strong and expensive bearings, or, if small bearings are used, it would drastically restrict the life time of the device, because small bearings have only a limited life under high load. The said balancing recesses or balancing pockets 68 and/or 69 of FIG. 3 are therefore highly desired for high pressure devices.

The fluid in balancing recess 68 exerts a force under pressure in said fluid in the direction of arrows 165 against the outer rotor 2. The dimensioning of the balancing recess 68 is preferredly done in such extent, that the forces which act out of delivery chamber 6 against the outer rotor 2 are equal in size of force respectively to the said force 165 out of balancing recess 68. Similarily the force of arrows 164 excerted against the inner rotor 1 is preferably made about equal to the force of arrows 166 which acts from the delivery chamber 6 against the inner rotor 1. When it is written here, that said forces are preferred to be made equal, it should be understood, that equalness means to the extent of practical machining ability. Thus, the forces may be made about equal, while an exact equalness in the strictly mathematical sense might not be obtained in practical application.

In order to make the directions of said fluid pressure forces visible in FIG. 3 the respective portions 2,26 of the outer rotor 2 are distanced in FIG. 3 from the inner rotor 1. It will be understood however, that said portions 2,26 are actually closely fitting along the respective portions 1,16 or rotor 1 or along the outer face of separation control member 3 respectively.

Figure 4:
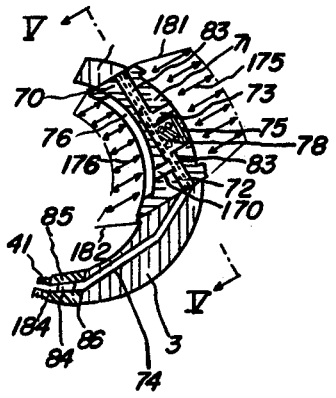
FIG. 4 is a cross-sectional view through still another embodiment of a separation-control member of the invention with thereto added further insertions.

FIG. 4 demonstrates, that the separation and control member 3 may also be provided with seal inserts 70 and/or 71, which are to be mounted radially moveable in a limited extend. They are inserted into a respective substantially radially directed chamber 170 in member 3. They are either closely sealing fitted therein or the may be sealed by respective seals between inserts 70 and/or 71 and the wall of chamber 170 in separation- and control-member 3. In addition, to replace the seal lips 43,44 of the other former figures, seal inserts 84 and/or 85 may be inserted into a respective further substantially radially directed chamber 184 in member 3. Said additional radial chamber should be provided closely to the deliver chamber 6 of the device. Said inserts 84 and/or 85 are also radially moveable and tighly sealing in said chamber. A spring means 86 may be provided between them for pre-loading them radially. Similarily a spring means 78 may be provided for pre-loading between inserts 70 and 71 in chamber 170.

Pressure fluid may be led from delivery chamber 6 through passage 41 into chamber 184 and on through passage 74 into chamber 170. Chamber 170 may be divided into two separate chambers by a divider 83, which is shown only in dotted lines. This driver 83 is however seldom applied in practice and more desired only, if only one insertion 70 or 71 is desired in the actual design. Passages 72 and/or 73 may lead the pressure fluid from chamber 170 or from passage 74 into respective balancing recess pockets 75 and/or 76 in inserts 70 and/or 71 respectively. The balancing recess pockets 75 and 76 are provided in the respective inserts 70 and 71 respectively and they are open towards the adjacent rotors 1 or 2 respectively. The arrows 175 show the action of the pressures in fluid in balancing pocket 75 and arrows 176 show the respective pressure balancing action out of balancing pocket 76. Lines 181 and 182 demonstrate by schematic the radial force of the respective pressure fields 175 and 176. The pressure narrows gradially over the sealing portions.

Thus, the inner and outer rotors 1 and/or 2 float radially between areas of fluid under pressure without any considerable rest of radially displacing load. The efficiency and life time of the device is thereby effectively increased. If the sealing surfaces of the inserts 70 or 71 would were off, they would move more radially against the respective rotor, so that sealing is assured also in case of wearing off of the seal faces of the inserts 70 and/or 71.

Figure 5:
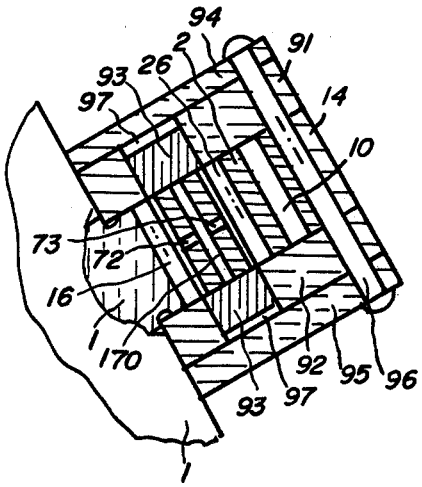
FIG. 5 is a sectional view through FIG. 4 along the line V—V of FIG. 4. Thereby it becomes a longitudinal sectional view through a device of the invention in part.

At the description of FIG. 1 it was explained, that the separation- and control-member 3 is fastened in the covers by pin means. FIG. 5 shows another embodiment in a partial longitudinal view and is a section through FIG. 4 along the line V—V. It demonstrates, that the separation-control member 93 may be elongated and be borne in respectively formed and located recesses 97 in the coverplates of the device. In such case it is suitable to apply inner covers 91,92 with said recesses 97 for bearing member 93 therein, while outer cover members 94,95 may close said recesses 97 outwardly. Bolts or rivetts 96 may hold the housing 14 and covers 94,91,92,95 together. The outer rotor 2 may have free radial play 10 within housing 14.

It may be understood, that in case of suitable design and machining, not only the inner and outer rotors 1 and 2 float freely under radially contrary directed forces of fluid under pressure, but the separation-control-member 3 also. Thus, the whole pump is free of radial rest loads. An extended life with good efficiency can therefore be expected from the device of the invention. Bearings can be spared or be of small inexpensive size. The freedom from radial loads can allow very high pressures, revolutions and power.

While a number of embodiments and modifications have been demonstrated, it may be understood, that these can be applied in combination respectively as is shown in the drawings, but that one or the other means of the invention may also be apllied singularily. Especially in low-pressure or in medial pressure devices.

The inserts, separation-control members and axially acting thrust bodies of the invention may also be applied in standard gear pumps with two axes and outer gears, if suitably configurated and located in respective housing portions of such outer gear-gearpumps or motors.

The axially moveable thrust body 18 may be provided with seals 99 and/or axial thrust spring means 100. It may have an eccentric shoulder 19 with a delivery passage 218 therethrough. An entrance passage 120 may be provided through seal plate 23 or through a respective portion of thrust body 18. The eccentric shoulder 19 and the respective chamber portion 22 in cover 15, wherein it is contained, are so dimensioned, that the force of pressure in fluid in chamber 22 presses the thrust body 18 evenly with the desired force against the to be sealed member or face.

While the entrance and exit passages are shown on one end of the device, it would also be possible to provide entrance and exit passages on the other end of the device too if so desired. Instead of axial flow of fluid as described it would also be possible to provide radial or partially radial flow of fluid, if respective passages or bores are provided through the respective rotor or rotors 1,2.

In order to further reduce friction it is possible and suitable to provide intersecting recesses in the respective parts. For example recesses 10,510,410, 161,162 in members 13,3 or others in FIGS. 1,3,4 or 6.

Figure 6:
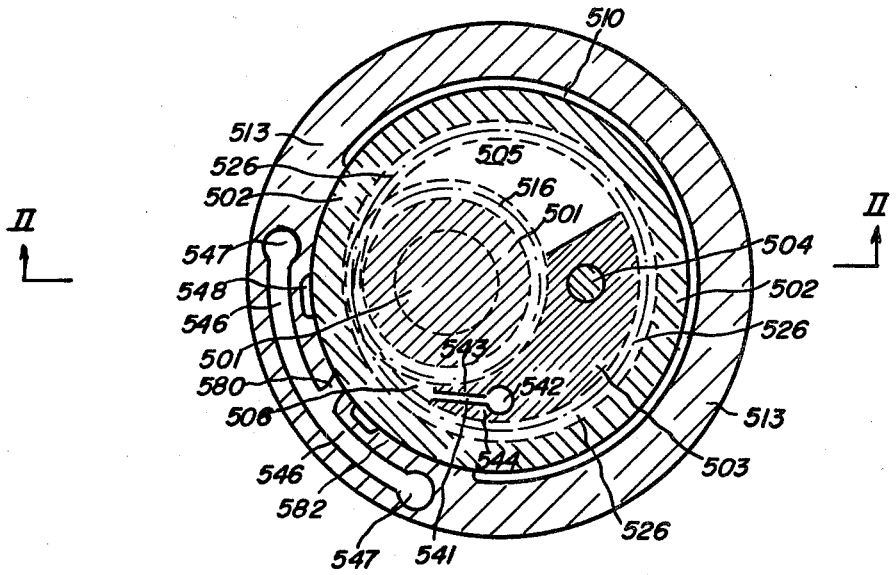
FIG. 6 is an alternative embodiment to FIG. 1, wherein all means of the invention are provided in parts, which are present in internal gear devices and wherein the means of the invention consists exclusively in slots and chambers. This alternative may be used instead of that of FIG. 1 if so desired.

The most simplest embodiment of the invention is shown in FIG. 6. It does not contain any more parts, than the commonly known internal gear pump of the former art. However, due to the invention, it is made tight and therefore capable of medial or of high pressure with good efficiency. The seal means of the invention are exclusively provided in this figure in the separation control member 503 and/or in the housing or housing insertion 513. In section II—II the device of FIG. 6 may be substantially equal to FIG. 2. We see housing member 513 and rotors 501 and 502 with teeth 516 and 526 wherebetween the entrance chamber 5 and the exit chamber 6 are formed. The separation- and control-member 503 is fastened by pin holder 504. According to the invention, the member 503 is provided with a space 542, which may be a bore and with a slot 541 for forming the deformable lips 543 and/or 544. These seal portions or lips act as the same means with equal end digets in FIG. 1 for sealing the pressure delivery chamber 6 in one of the peripherial directions. The housing member 513 is provided or may be provided with the fluid pressure space 546 and a slot 580. Thereby the sealing lips 581 and 582 are formed as deflectable portions for sealing along the outer face of rotor 2. Space 546 may extend to or be bordered by spaces or bores 547. Space 564, lips 581 and 582 as well as slot 580 may serve a plurality of purposes. First for sealing along the outer face of the outer rotor 502, second for lubricating therealong and third for pressing the lips 581 and/or 582 against the outer rotor 2 and thereby to press the outer rotor 2 towards sealing engagement with its teeth 516 in the teeth or on the teeth 516 of inner rotor 1. Lubrication recesses 548 may be provided, if so desired. Intersecting spaces 510 are highly desired and may be provided for reducing friction and also for making a radial movement of outer rotor 2 under the force of lips 581 and/or 582. Intersecting recess 410 in FIG. 1 serves also for reduction of friction. The device, which gets a member of FIG. 3 in any case needs an intersecting recess 10 or 510 outwards of rotor 2 if radial displaceability or rotor 2 is desired.

Attention is requested to spaces or bores with end digets 42,47 of the figures. It is recommended to machine these bores by drilling. Drills are available inexpensively at every desired diameter. Drilling with 0.1 mm bigger drill makes the respective lips much more deformable and contrary, drilling the bores a few tenth of a mm smaller diameter makes the lips much less deformable. The location and diameter of the bores with end digets 41 and 47 therefore highly influence the sealing ability of the device and are decisive often for which pressure range the device shall obtain its best efficiency and power.

While a number of different embodiments have been described in the specification, it should be understood, that the device commonly has a specific pressure range at actual application. For high pressure ranges the most effective means of the invention might be applied. For medial or low pressure ranges it is however often satisfactory to provide only the seal lips or the means of FIG. 6. For practical use the costs and the achieved results should be compared.

The device of the invention has been described as a gear pump. But it is possible also, to run the device as an internal gear fluid motor. In such case soft corners are desired at begin of the seal lips. In the drawings the soft corners of seal lips are drawn for application as a pump.

FIG. 3, as described, is provided with a plurality of recesses and seal face portions. Recess 68 may may be called a first recess, recess 161 may be called a second recess, recess 69 may be called a third recess and recess 162 may be called a fourth recess. The outer faces which may deform in the direction of arrows 156,159,144 may be called outer face portions; whereof the medial face portion is located between the first and second recess 68,161. The inner face portions which deform in the direction of arrows 55,162 and 143 may be called inner face portions, whereof the medial face portion is located between the third and fourth recesses 69 and 162.

What is claimed is:

1. An internal gear hydraulic device, comprising: an externally-toothed pinion; means for driving said pinion; an internally-toothed ring gear meshing with said pinion; a cresent shaped separation member disposed between said pinion and said ring gear; a housing sorrounding said ring gear; covers attached to said housing, one cover on each end of said housing; said covers including bearing means for the bearing of said means for driving said pinion; said housing and said covers forming on outside of said device; a high-pressure chamber and a low pressure chamber formed in said device; an inlet passage extending from said outside to one of said chambers and an outlet passage extending from the other of said chambers to said outside; one of said chambers being formed by one end of said member, portions of said covers, housing, gear and pinion and the other of said chambers formed on the other end of said member and between other portions of said housing, covers, gear and pinion; substantially as known from the former art and as common in internal gear devices;

wherein a novel arrangement is provided;

wherein said novel arrangement includes a deflectable housing lip on a portion of said housing, wherein said lip forms the inner wall of a slot, wherein said slot extends axially from one end of said portion through said portion to the other end of said portion of said housing, wherein said slot and said lip are located radially of one of said chambers, wherein said slot includes at least two radial enlargements, wherein said enlargements are located on the ends of said slot, wherein said enlargements extend radially inwardly;

wherein said enlargements form narrowed portions on said lip, wherein said lip between said narrowed portions is radially deflectible, wherein a passage is provided from said one of said chambers to said slot;

wherein fluid communicates through said passage with said one chamber and said slot to equalize the pressure in fluid in said one chamber and in said slot, wherein said slot is slightly longer in the peripheral direction than said one chamber, and wherein said lip is pressed by pressure in fluid in said slot against the outer face of said ring gear, when pressure is present in said fluid in said one chamber and in said slot.

2. An internal gear hydraulic device, comprising: an externally-toothed pinion; means for driving said pinion; an internally-toothed ring gear meshing with said pinion;a crescent shaped separation member disposed between said pinion and said ring gear; a housing sorrounding said ring gear; covers attached to said housing, one cover on each end of said housing; said covers including bearing means for the bearing of said means for driving said pinion; said housing and said covers forming an outside of said device; a high-pressure chamber and a low pressure chamber formed in said device; an inlet passage extending from said outside to one of said chambers and an outlet passage extending from the other of said chambers to said outside; one of said chambers being formed by one end of said member, portions of said covers, housing, gear and pinion and the other of said chambers formed on the other end of said insert and between other portions of said housing, covers, gear and pinion; substantially as known from the former art and as common in internal gear devices;

wherein a novel arrangement is provided;

wherein said novel arrangement includes a radially extending space, wherein said radially extending space extends radially through said crescent-shaped separation member, wherein two radially moveable seal inserts are provided in said space in said separation member, wherein said seal inserts are closely fitting in said separation member and have spring means inserted between said two seal inserts for pressing them apart from each other, wherein radially extending communications are provided through said seal inserts, wherein a space portion is formed between said seal inserts and within said crescent-shaped separation member, wherein one of said inserts is an outer insert and the other is an inner insert, wherein the said outer insert forms a pocket radially open in radial outward direction for communication with said ring gear, wherein said inner insert forms a pocket radially open in radially inward direction for communication with said pinion, wherein a communication passage extends from one of said chambers to said space portion between said inserts and wherein said outer insert is pressed against said ring gear and said inner insert is pressed against said pinion when fluid contains pressure in said one of said chambers.

3. An internal gear hydraulic device, comprising: an externally-toothed pinion; means for driving said pinion; an internally-toothed ring gear meshing with said pinion; a crescent shaped separation member disposed between said pinion and said ring gear; a housing sorrounding said ring gear; covers attached to said housing, one cover on each end of said housing; said covers including bearing means for the bearing of said means for driving said pinion; said housing and said covers forming an outside of said device; a high-pressure chamber and a low pressure chamber formed in said device; an inlet passage extending from said outside to one of said chambers and on outlet passage extending from the other of said chambers to said outside; one of said chambers being formed by one end of said insert, portions of said covers, housing, gear and pinion and the other of said chambers formed on the other end of said member and between other portions of said housing, covers, gear and pinion; substantially as known from the former art and as common in internal gear devices;

wherein a novel arrangement is provided;

wherein said novel arrangement includes a plurality of recesses, wherein said recesses of said plurality of recesses are provided in said crescent-shaped separation member, wherein two of said recesses are extended radially inwardly from the outer face of said separation member into said separation member, wherein a third and a fourth recess are extended radially outwardly from the inner face of said separation member into said separation member, wherein said outer face of said separation member includes three outer face portions, one thereof between said two recesses, wherein said inner face of said separation member includes three inner face portions, one thereof between said third and said fourth recess, wherein an internal space is provided between the medial face portions of said separation member within said separation member and extending axially through said separation member, wherein a passage communication is extended from one of said chambers to said internal space, wherein said internal space forms two radially deflectible seal portions in said separation member whereof one carries the medial face portion of said three outer face portions and the other carries the medial face portion of said three inner face portions, wherein said separation member is fastened by a retainer to said covers for the prevention of peripherial movement, wherein said separation member forms two thrust chambers, one of said thrust chambers close to one peripherial end and the other close to the other peripherial end of said separation member, wherein said thrust chambers are communicated to said one of said chambers, wherein said thrust chambers extend fifth and sixth recesses for forming third, fourth, fifth and sixth seal portions on said crescent-shaped separation member and wherein said seal portions are pressed against said pinion and said ring gear respectively for sealing against them when pressure is present in the fluid in said one chamber.

4. An internal gear hydraulic device, comprising: an externally-toothed pinion; means for driving said pinion; an internally-toothed ring gear meshing with said pinion; a separation member disposed between said pinion and said ring gear; a housing sorrounding said ring gear; covers attached to said housing, one cover on each end of said housing; said covers including bearing means for the bearing of said means for driving said pinion; said housing and said covers forming an outside of said device; a high-pressure chamber and a low pressure chamber formed in said device; an inlet passage extending from said outside to one of said chambers and an outlet passage extending from the other of said chambers to said outside; one of said chambers being formed by one end of said member, portions of said covers; housing, gear and pinion and the other of said chambers formed on the other end of said member and between other portions of said housing, covers, gear and pinion; substantially as known from the former art and as common in internal gear devices; wherein said ring gear is radially displaceable;

wherein a novel arrangement is provided;

wherein said novel arrangement includes a deflectable housing sealportion on a portion of said housing;

wherein said sealportion forms the inner wall of a space;

wherein said space extends axially from one end of said portion through said portion to the other end thereof;

wherein said space and said sealportion are located radially of one of said chambers, wherein said sealportion is radially deflectable inwardly;

wherein a passage is provided from said one of said chambers to said space;

wherein fluid communicates through said passage with said one chamber and said space to equalize the pressure in fluid in said one chamber and in said space;

wherein said separation member includes a slot which forms two seal-lips adjacent said slot and at least partially radially inward of said deflectable housing sealportion, wherein said slot communicates with said one chamber, said lips engage said gears and being pressed against said gears respectively by pressure in fluid in said slot;

wherein said sealportion is slightly longer in the peripherial direction than said one chamber, wherein said sealportion is pressed by pressure in fluid in said space radially inwardly against the outer face of said ringgear and wherein the peripheral length through said space is slightly longer than the peripheral length through said one chamber and its adjacent sealing means whereby the force of pressure in said space and thereby the radial inward deflection of said seal portion slightly exceeds the radially outwardly directed force of pressure in fluid in said one chamber and its adjacent seal means for assuring a close engagement of the teeth of said ring-gear and said pinion for the prevention of leakage out of said one chamber through the area of engagement of said teeth of said ring gear and of said pinion.

* * * * *